US007789710B2

(12) United States Patent
Chiang

(10) Patent No.: US 7,789,710 B2
(45) Date of Patent: Sep. 7, 2010

(54) POWER CABLE CONNECTOR COMPATIBLE TO SATA AND IDE STANDARDS

(76) Inventor: Chu-Shan Chiang, 3F., No. 133, Zhongshan Rd., Sanchong City, Taipei Hsien (TW)

( * ) Notice: Subject to any disclaimer, the term of this patent is extended or adjusted under 35 U.S.C. 154(b) by 92 days.

(21) Appl. No.: 12/344,930

(22) Filed: Dec. 29, 2008

(65) Prior Publication Data

US 2009/0176390 A1 Jul. 9, 2009

(30) Foreign Application Priority Data

Jan. 4, 2008 (CN) ..... 2008 2 0042494 U

(51) Int. Cl.
*H01R 25/00* (2006.01)

(52) U.S. Cl. ..... 439/638

(58) Field of Classification Search ..... 439/638
See application file for complete search history.

(56) References Cited

U.S. PATENT DOCUMENTS 6,722,897 B1 * 4/2004 Wu ..... 439/76.1
7,207,831 B2 4/2007 Chen et al.
2003/0008565 A1 * 1/2003 Chang ..... 439/638

* cited by examiner

*Primary Examiner*—Edwin A. Leon
*Assistant Examiner*—Vanessa Girardi
(74) *Attorney, Agent, or Firm*—Rabin & Berdo, P.C.

(57) ABSTRACT

A power cable connector compatible with Serial Advanced Technology Attachment (SATA) and Integrated Device Electronics (IDE) standards has a SATA connector module and an IDE connector module. The SATA connector module has a SATA connector plug and multiple SATA power terminals. The IDE connector module has an IDE connector plug and multiple IDE power terminals. The IDE connector plug has a chamber having a detour guide. The SATA connector plug is detachably mounted in the chamber. The IDE power terminals are mounted in the IDE connector plug, detachably and respectively contact the SATA power terminals. Each IDE power terminal has a connecting element. One of the connecting elements of the IDE power terminals is mounted along the detour guide to prevent short circuit and facilitate manufacture. Therefore, the SATA power terminals are not separated by a separate insulator for improved production yield and performance.

20 Claims, 15 Drawing Sheets

POWER CABLE CONNECTOR COMPATIBLE TO SATA AND IDE STANDARDS

BACKGROUND OF THE INVENTION

1. Field of the Invention

The present invention relates to a power cable connector, and more particularly to a power cable connector being compatible with Serial Advanced Technology Attachment (SATA) and Integrated Device Electronics (IDE) standards.

2. Description of Related Art

Floppy disk drive (FDD) devices, IDE devices and SATA devices may be installed in some computers together, especially document control, library or archive computers. If the computers provide only SATA power connectors, the FDD devices and the IDE devices cannot be powered by the power supply in the same computers.

To overcome the above-mentioned shortcomings, with reference to FIG. 15, a conventional power connector meeting SATA and IDE standards as described in U.S. Pat. No. 7,207,831 is taught. The conventional power connector has a SATA connector plug (40), an IDE connector plug (50), a terminal assembly and an insulation element (70). The SATA connector plug (40) and the IDE connector plug (50) are respectively disposed on two sides. The terminal assembly comprises multiple IDE power terminals (51) and multiple SATA power terminals (41) respectively arranged as Live-Ground-Ground-Live and Live-Ground-Live-Ground-Live. Therefore, two adjacent SATA and IDE power terminals (41, 51) are not aligned with corresponding adjacent IDE and SATA power terminals (51, 41). Multiple connection segments (61, 62) respectively connect the SATA and IDE power terminals (41, 51). Two connection segments (62) are crooked to cross over each other so each connects a corresponding IDE power terminal (51) and a corresponding SATA power terminal (41). The insulation element (70) is mounted between the crooked connection segments (62) and other connection segments (61) adjacent to the crooked connection segment (62) to prevent contact and short circuits between the connection segments (61, 62). When the IDE connector plug (50), the SATA connector plug (40), the terminal assembly and the insulation element (70) are assembled together, the insulation element (70) will be pressed by the connection segments (61, 62).

However, a finished conventional power connector may be rejected due to misalignment of the insulation element (70) during manufacture, and such misalignment may:

allow the crooked connection segment (62) to contact other connection segments (61) causing short circuit;

cause the insulation element (70) to break the connection segments (61, 62); or cause the IDE power terminals (51) to move out of line so the connection of IDE power terminals (51) with an IDE device may be broken, or the IDE device may be jammed or damaged.

Furthermore, the conventional power connectors must be assembled with power wires on power supplies by manufacturers. End-users cannot disassemble and reassemble the conventional power connectors, such as replacing broken conventional power connectors.

To overcome the shortcomings, the present invention provides a power cable connector compatible to SATA and IDE standards to mitigate or obviate the aforementioned problems.

SUMMARY OF THE INVENTION

The main objective of the invention is to provide a power cable connector compatible with Serial Advanced Technology Attachment (SATA) and Integrated Device Electronics (IDE) standards.

The power cable connector in accordance with the present invention comprises a SATA connector module and an IDE connector module. The SATA connector module has a SATA connector plug and multiple SATA power terminals. The IDE connector module is detachably connected to the SATA connector module and has an IDE connector plug and multiple IDE power terminals. The IDE connector plug has a chamber having an inner surface and a detour guide. The SATA connector plug is detachably mounted in the chamber. The IDE power terminals are mounted in the IDE connector plug, detachably and respectively contact the SATA power terminals. Each IDE power terminal has a connecting element. One of the connecting elements of the IDE power terminals is mounted along the detour guide to prevent short circuit and facilitate manufacture. Therefore, the SATA power terminals are not separated by a separate insulator for improved production yield and performance. Furthermore, because the IDE and SATA power terminals are mounted respectively in the IDE and SATA connector plug, the IDE connector module and the SATA connector module are independent and are detachably connected together. End-users can easily disassemble and reassemble the power cable connector.

Other objectives, advantages and novel features of the invention will become more apparent from the following detailed description when taken in conjunction with the accompanying drawings.

DETAILED DESCRIPTION OF PREFERRED EMBODIMENT

Figure 1:
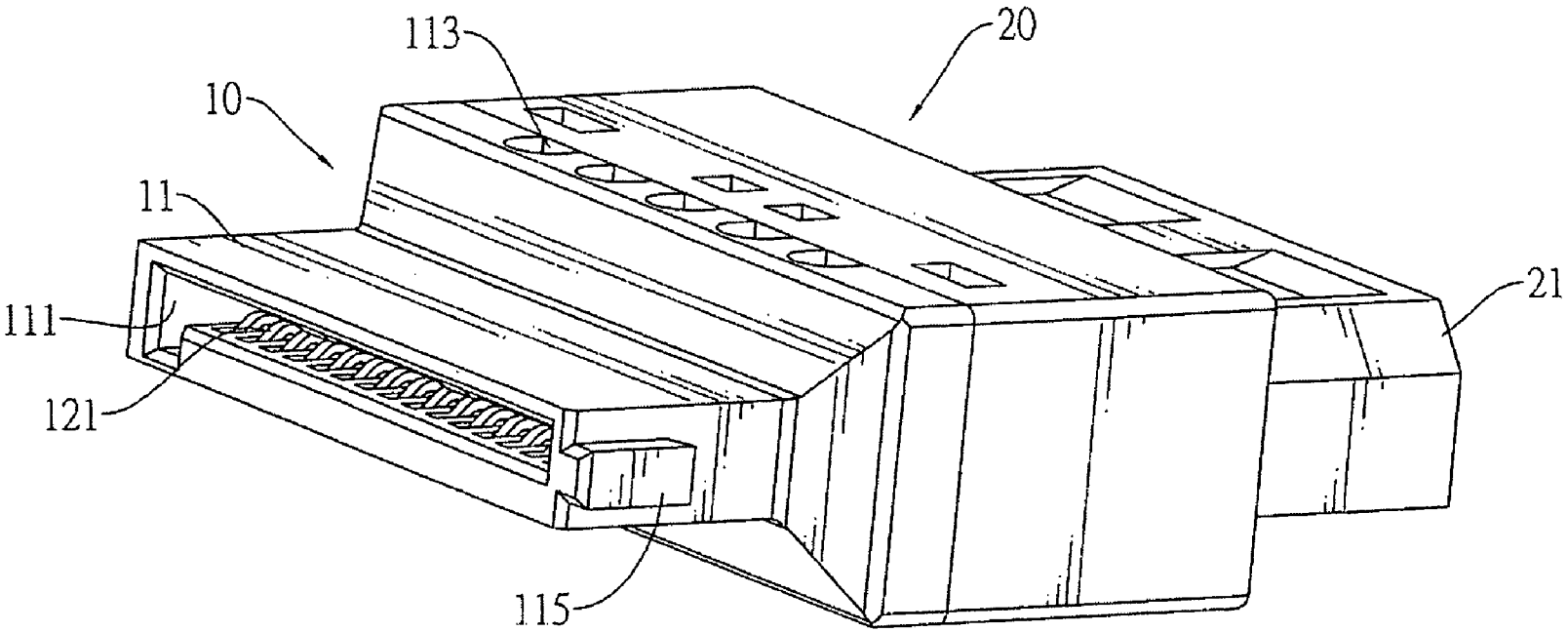
FIG. 1 is a perspective view of a first embodiment of a power cable connector in accordance with the present invention.
Figure 2:
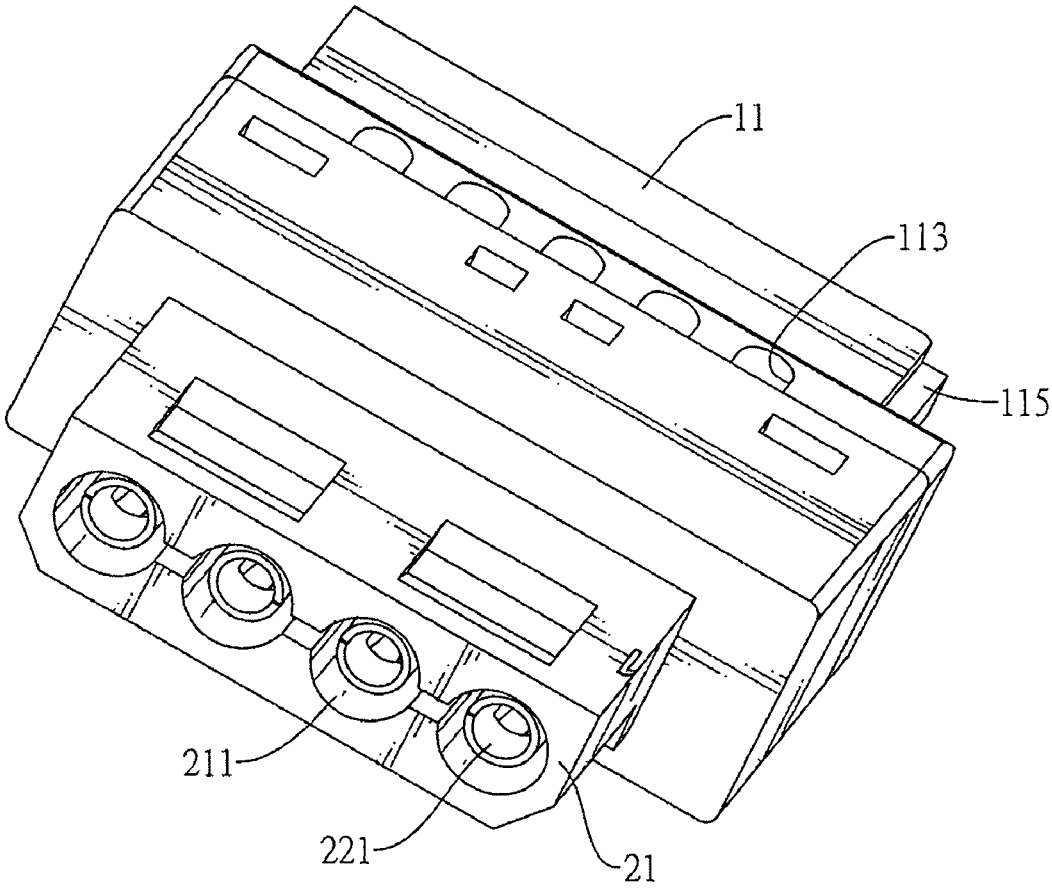
FIG. 2 is another perspective view of the power cable connector in FIG. 1.
Figure 7:
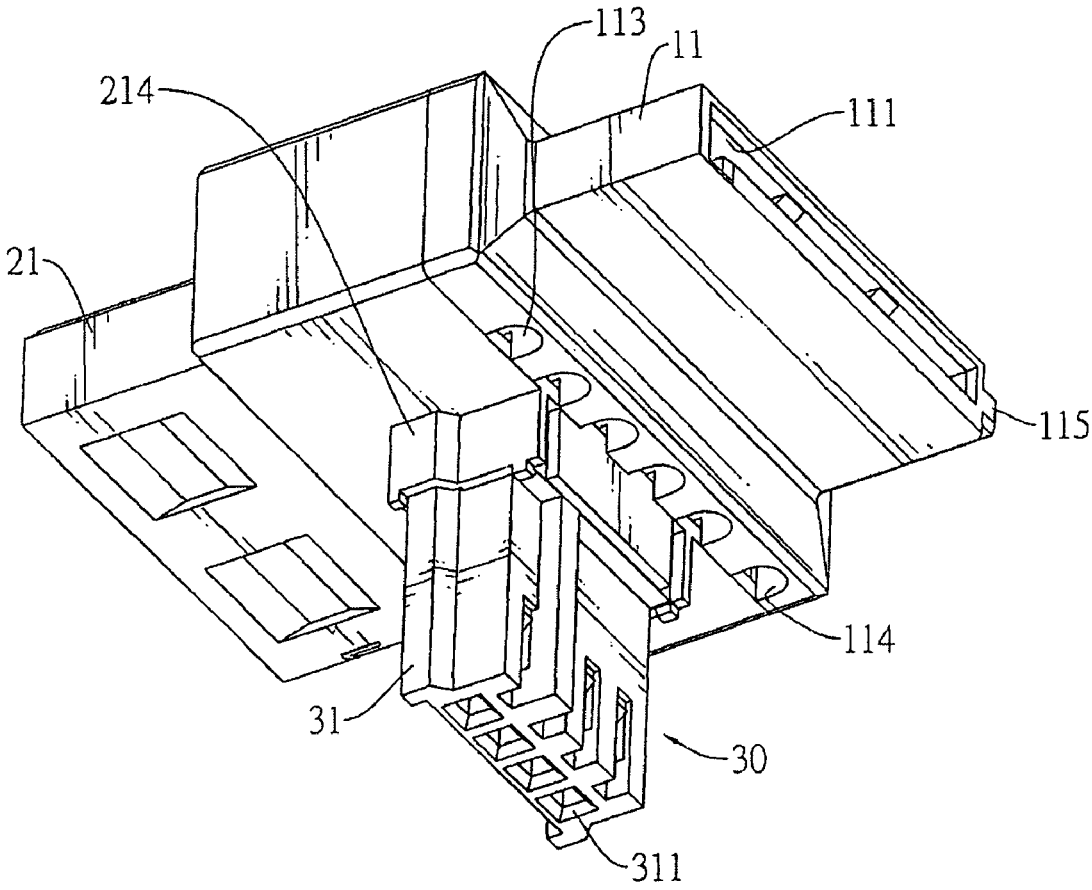
FIG. 7 is a perspective view of a second embodiment of a power cable connector in accordance with the present invention.

With reference to FIGS. 1, 2 and 7, a power cable connector in accordance with the present invention comprises a Serial Advanced Technology Attachment (SATA) connector module (10), an Integrated Device Electronics (IDE) connector module (20) and an optional floppy disk drive (FDD) connector module (30).

Figure 3:
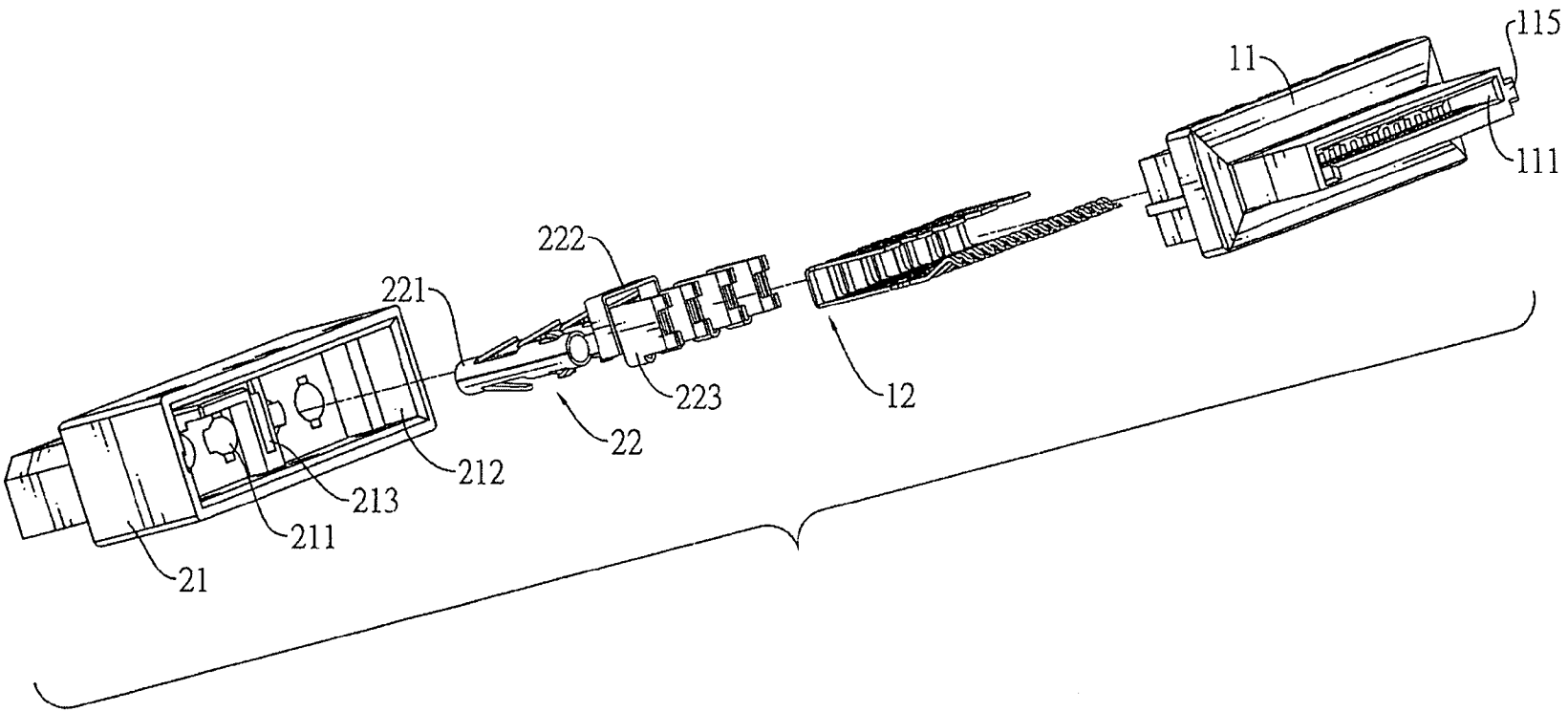
FIG. 3 is an exploded perspective view of the power cable connector in FIG. 1.
Figure 5:
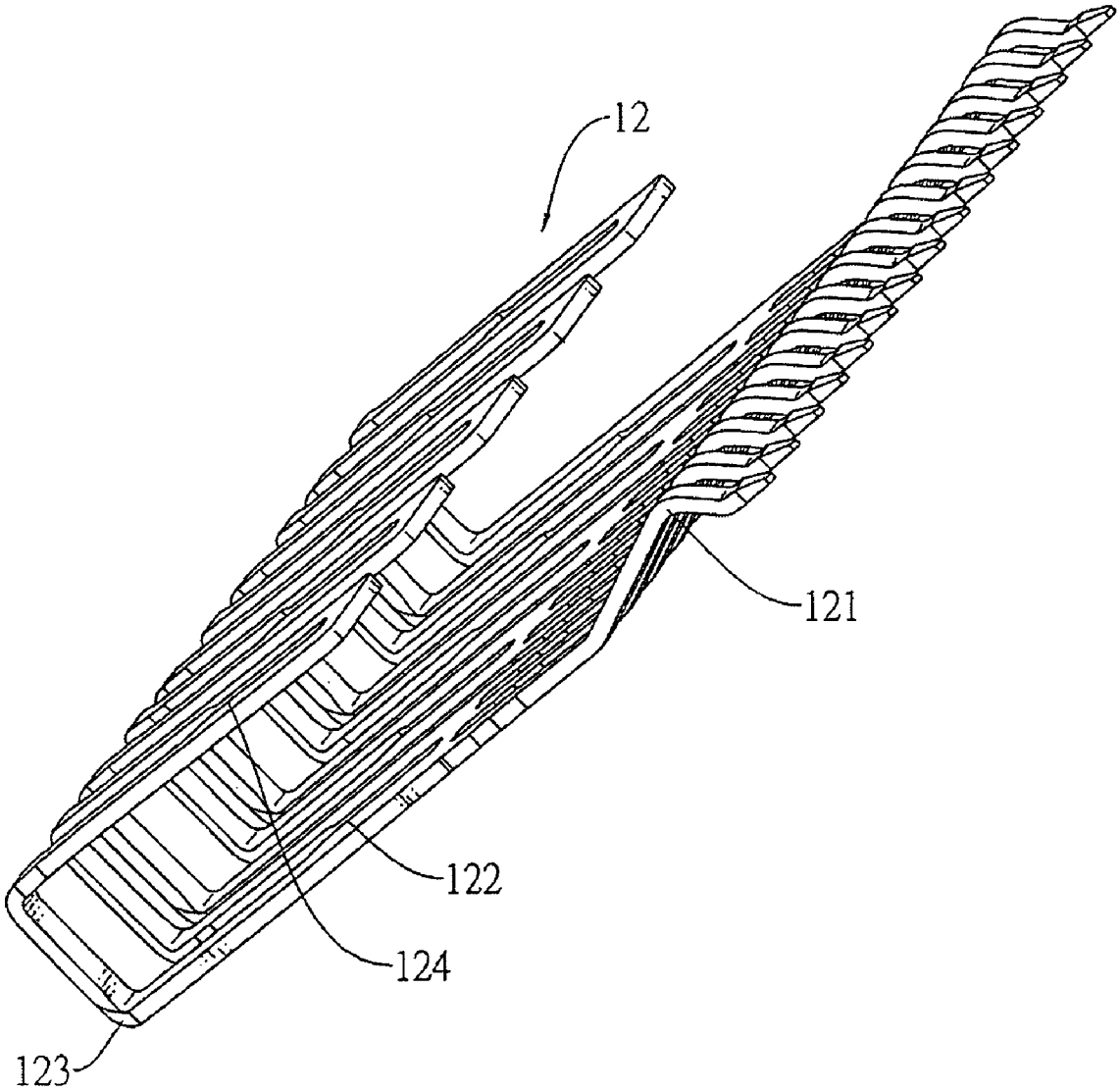
FIG. 5 is a perspective view of Serial Advanced Technology Attachment (SATA) power terminals of the power cable connector in FIG. 1.
Figure 6:
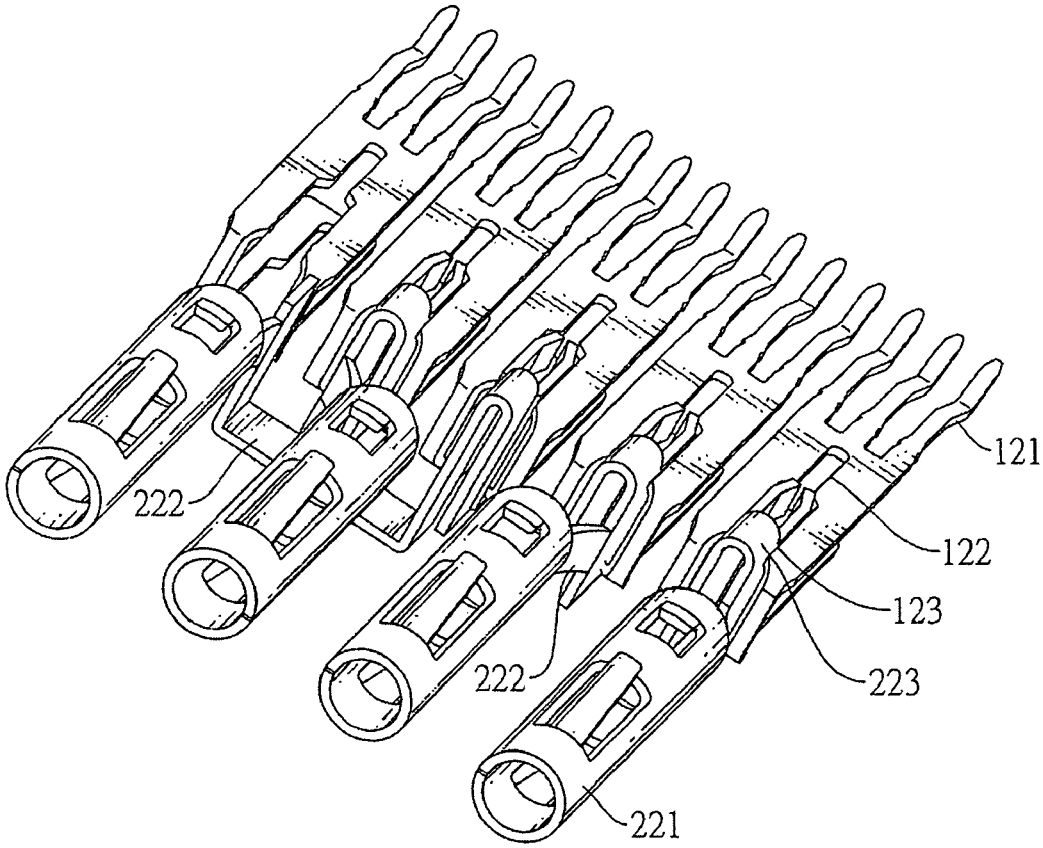
FIG. 6 is a perspective view of the IDE power terminal in FIG. 4 connecting with the SATA power terminals in FIG. 5.
Figure 8:
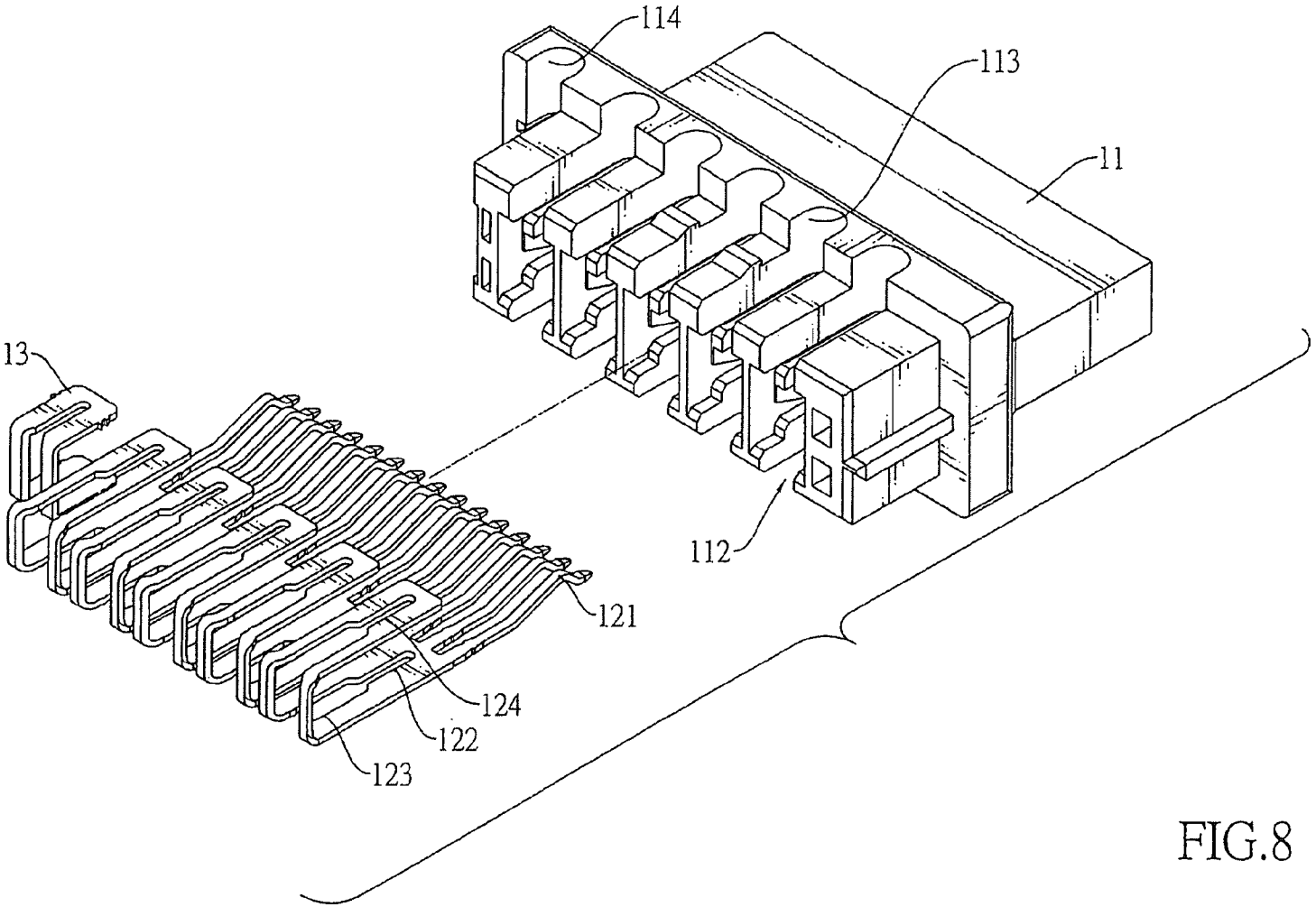
FIG. 8 is an exploded view of a SATA connector module of the power cable connector in FIG. 7.

With further reference to FIGS. 3, 5 and 8, the SATA connector module (10) comprises a SATA connector plug (11), multiple SATA power terminals (12) and an optional static elimination clip (13).

The SATA connector plug (11) has a top, a bottom, a connecting side, a mounting side, a flat edge, a guide edge, a slot (111), multiple recesses (112), multiple through holes (113), an optional static hole (114) and a guiding protrusion (115). The slot (111) is formed through the connecting side of the SATA connector plug (11). The recesses (112) are formed on the mounting side of the SATA connector plug (11) and communicate with the slot (111). The through holes (113) are formed through the top and the bottom of the SATA connector plug (11) and correspond respectively to and communicate with the recesses (112). The static hole (114) is formed through the top and the bottom of the SATA connector plug (11) adjacent to the guide edge. The guiding protrusion (115) is formed on and protrudes from the guide edge of the SATA connector plug (11).

The SATA power terminals (12) are mounted in the SATA connector plug (11), comprise 3.3V, first ground, 5V, second ground and 12V SATA power terminals (12) disposed in series from the flat edge to the guide edge of the SATA connector plug (11) and correspond respectively to the recesses (112). Each SATA power terminal (12) may have multiple connecting contacts (121), a center contact (122), a mounting clip (123) and a top contact (124). The connecting contacts (121) are mounted in the slot (111) of the SATA connector plug (11) and are adapted to electrically connect to a SATA device. Each center contact (122) is formed on the connecting contacts (121) of a corresponding SATA power terminal (12) and aligns with a corresponding through hole (113) on the SATA connector plug (11). Each mounting clip (123) is formed on the center contact (122) of the corresponding SATA power terminal (12) and exposes through a corresponding recess (112). Each top contact (124) is formed on the mounting clip (123) and aligns with the center contact (122) of the corresponding SATA power terminal (12) and the corresponding through hole (113) on the SATA connector plug (11).

The static elimination clip (13) is mounted in and protrudes from the mounting side of the SATA connector plug (11), may be from the static hole (114).

Figure 4:
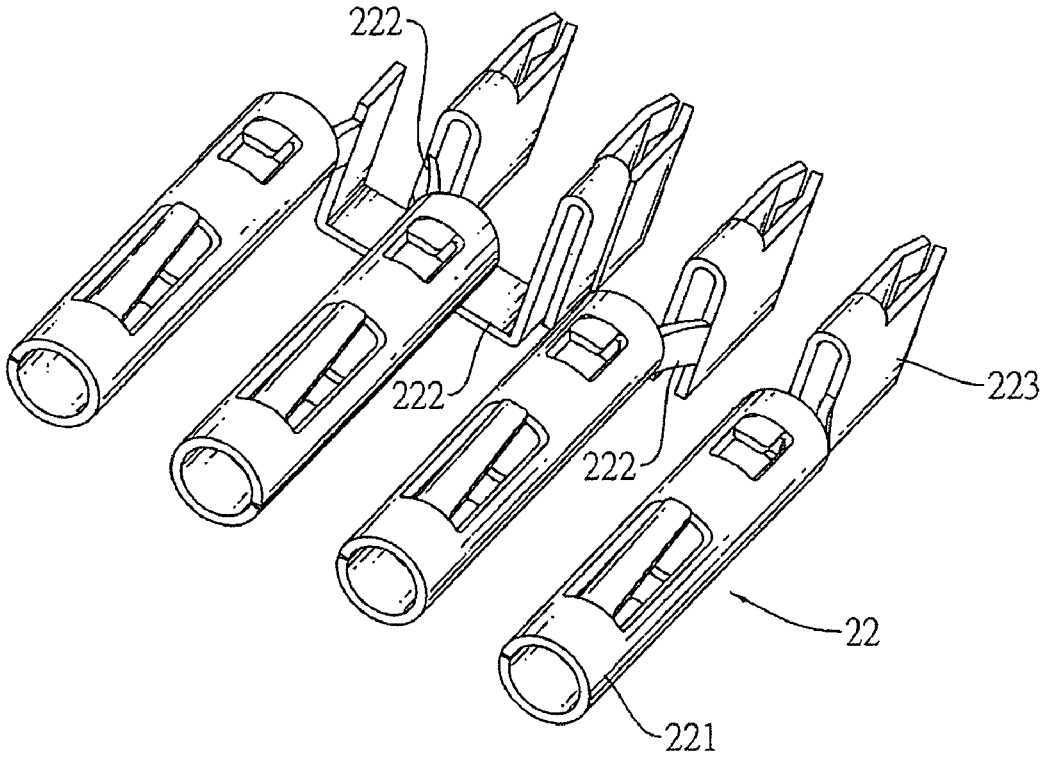
FIG. 4 is a perspective view of Integrated Device Electronics (IDE) power terminals of the power cable connector in FIG. 1.
Figure 9:
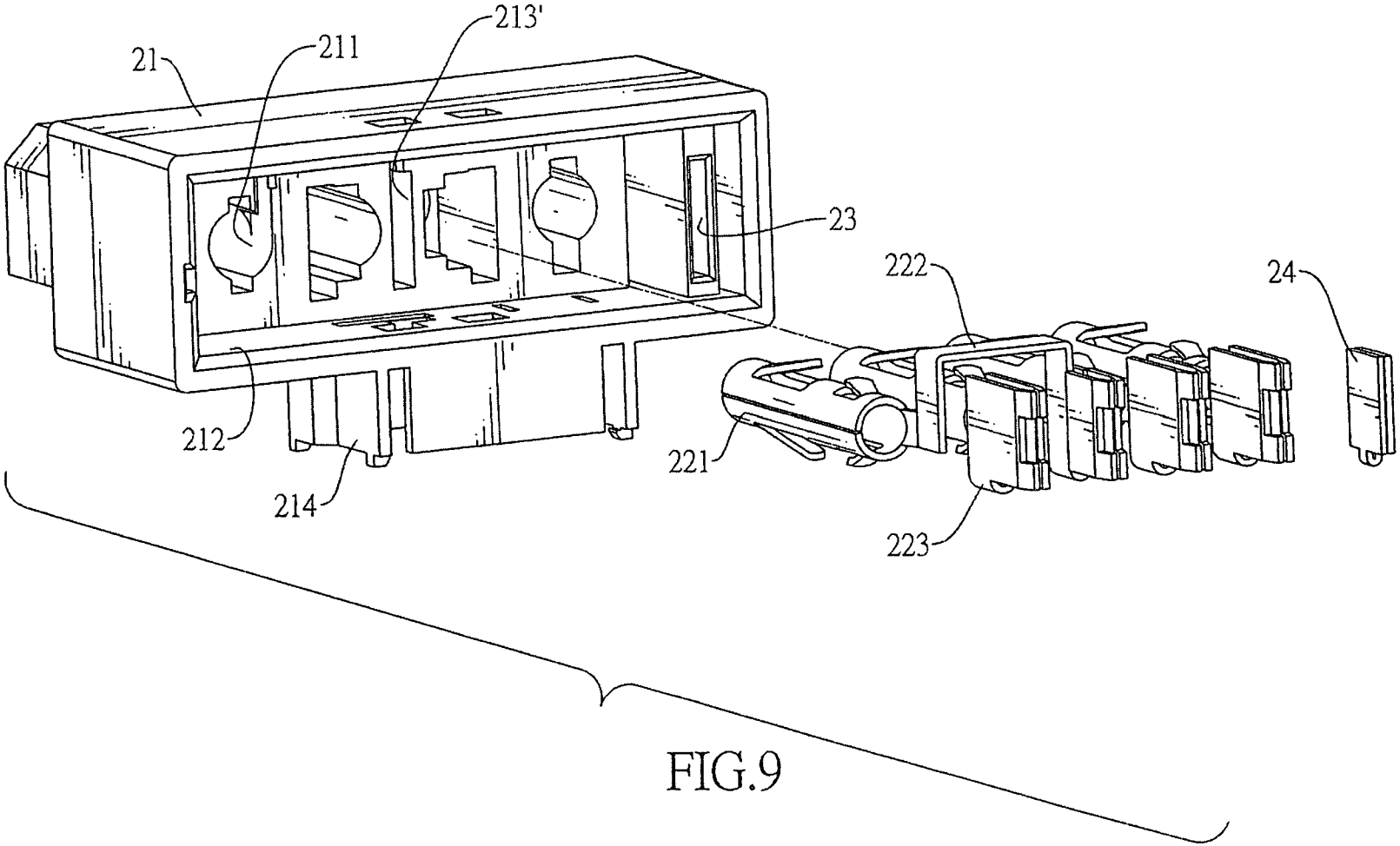
FIG. 9 is an exploded perspective view of an IDE connector module of the power cable connector in FIG. 7.
Figure 10:
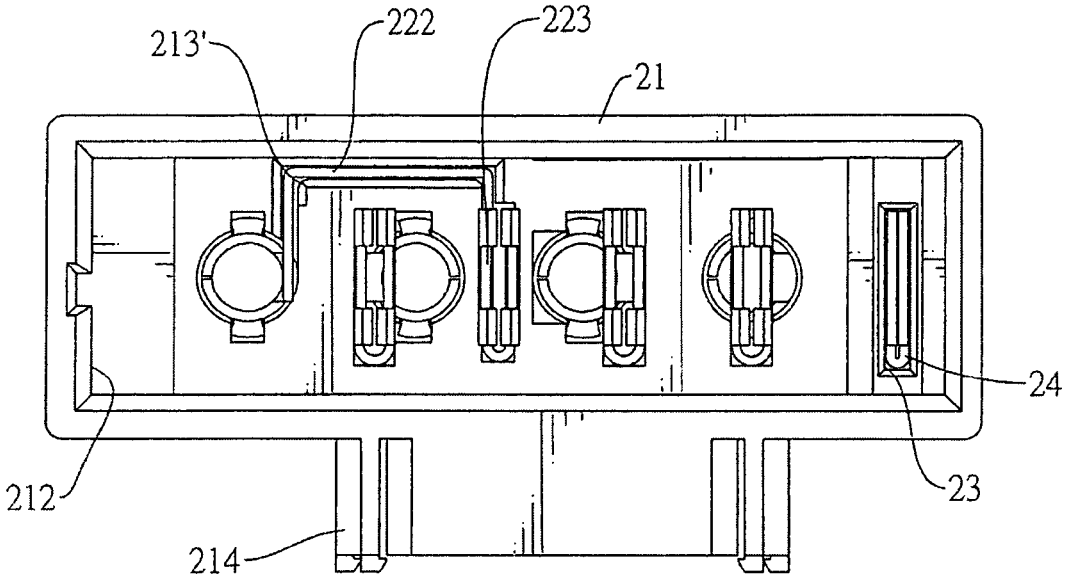
FIG. 10 is a mounting side view of the IDE connector module in FIG. 9.

With further reference to FIGS. 4, 9 and 10, the IDE connector module (20) is detachably connected to the SATA connector module (10) and comprises an IDE connector plug (21), multiple IDE power terminals (22), an optional static cavity (23) and an optional static elimination piece (24).

The IDE connector plug (21) has a mounting side, a connecting side, two edges, a bottom, multiple terminal holes (211), a chamber (212), a detour guide and an optional FDD mount (214). The edges of the IDE connector plug (21) correspond respectively to the flat and guide edges on the SATA connector plug (11). The terminal holes (211) are formed through the connecting side of the IDE connector plug (21) and formed individually in series from the edge of the IDE connector plug (21) corresponding to the flat edge of the SATA connector plug (11) to the other edge of the IDE connector plug (21). The chamber (212) is formed through the mounting side of the IDE connector plug (21) and is detachably mounted around the mounting side of the SATA connector plug (11). The chamber (212) communicates with the terminal holes (211) and has an inner surface. The detour guide is on the inner surface of the chamber (212) and around one of the terminal holes (211). The detour guide may be a relief ditch (213) formed on the inner surface of the chamber (212) or a guide notch (213') formed in the inner surface of the chamber (212). The FDD mount (214) is formed on and through the bottom of the IDE connector plug (21).

With further reference to FIGS. 6, 12, 13 and 14, the IDE power terminals (22) comprise 5V, first ground, second ground and 12V IDE power terminals (22) contacting respectively with the 5V, first ground, second ground and 12V SATA power terminals (12). The 5V, first ground, second ground and 12V IDE power terminals (22) are mounted respectively in the terminal holes (211) from the edge of the IDE connector plug (21) corresponding to the flat edge of the SATA connector plug (11) to the other edge of the IDE connector plug (21). Each IDE power terminal (22) comprises a connecting contact (221), a connecting element (222) and a mounting contact (223). The connecting contacts (221) are mounted in the terminal holes (211) and are adapted to connect to an IDE device. Each connecting element (222) is formed on the connecting contact (221) of a corresponding IDE power terminal (22). The connecting element (222) of the 5V IDE power terminal (22) is mounted along the detour guide in the IDE connector plug (21) to detour round the connecting element (222) of the first ground IDE power terminal (22) and avoid other connecting elements (222) short circuiting. Each mounting contact (223) is formed on the connecting element (222) of the corresponding IDE power terminal (22) and detachably contacts with the mounting clip (123) of a corresponding SATA power terminal (12).

The static cavity (23) is formed in the inner surface of the chamber (212), next to the 12V IDE power terminal (22) and adjacent to the edge of the IDE connector plug (21) corresponding to the guide edge of the SATA connector plug (11).

The static elimination piece (24) is mounted in and protrudes from the static cavity (23) and detachably contacts the static elimination clip (13). If the static elimination clip (13) electrically contacts with a ground wire, the connected static elimination piece (24), the static elimination clip (13) and the ground wire eliminate interference caused by static electricity and power surges on the power cable connector.

Figure 11:
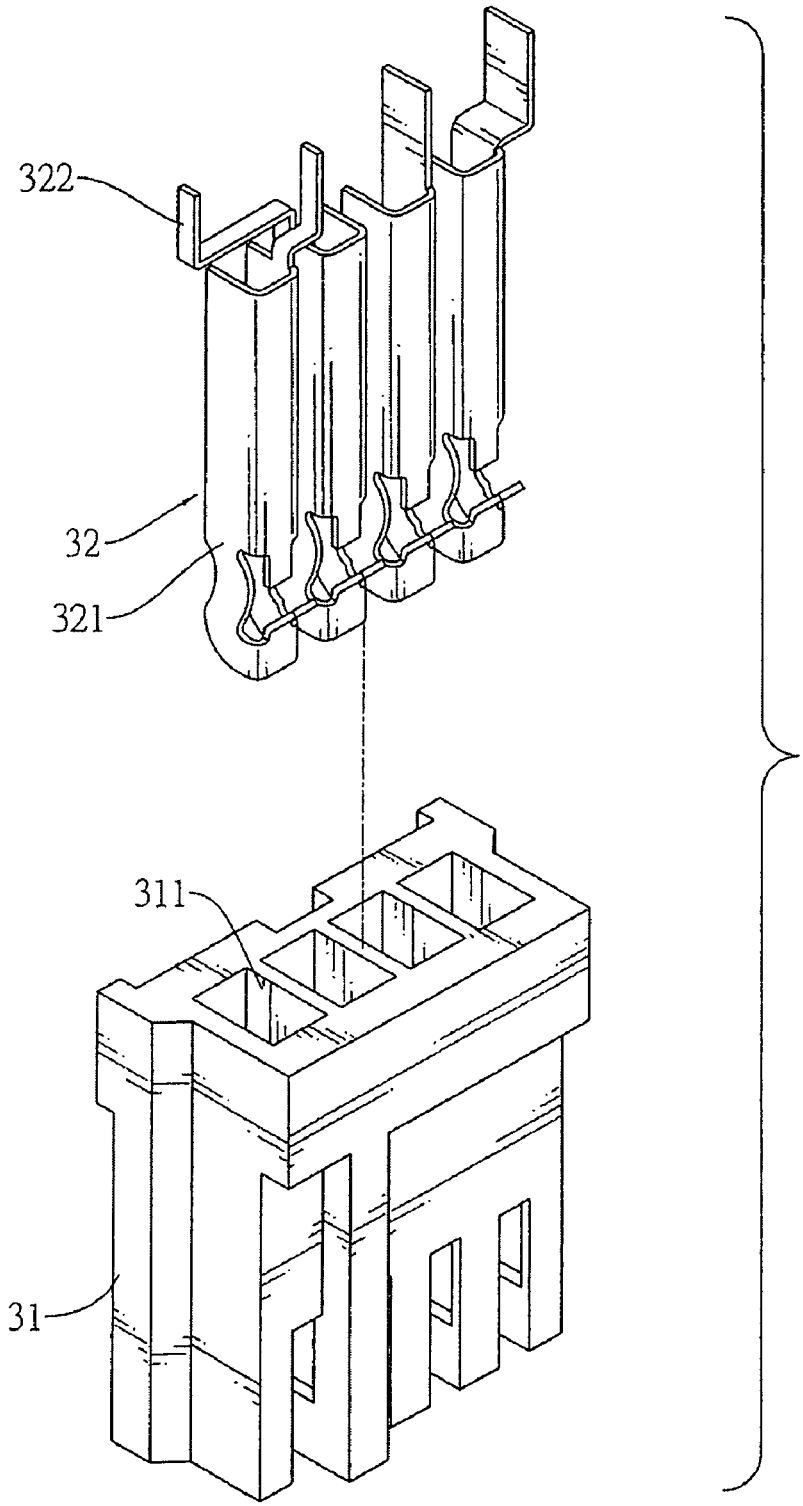
FIG. 11 is an exploded perspective view of a floppy disk drive (FDD) connector module of the power cable connector in FIG. 7.
Figure 12:
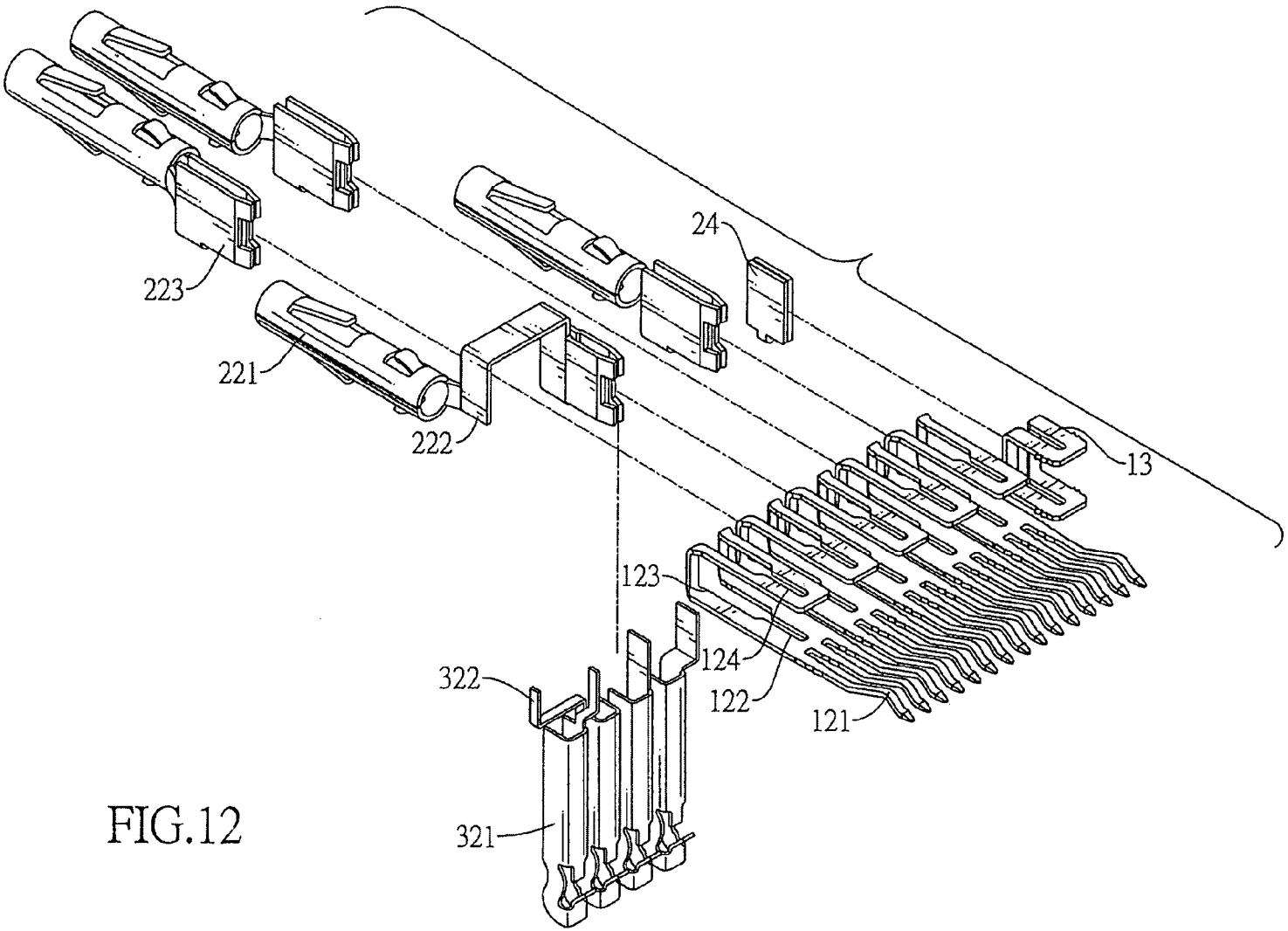
FIG. 12 is an exploded perspective view of internal elements of the power cable connector in FIG. 7.
Figure 13:
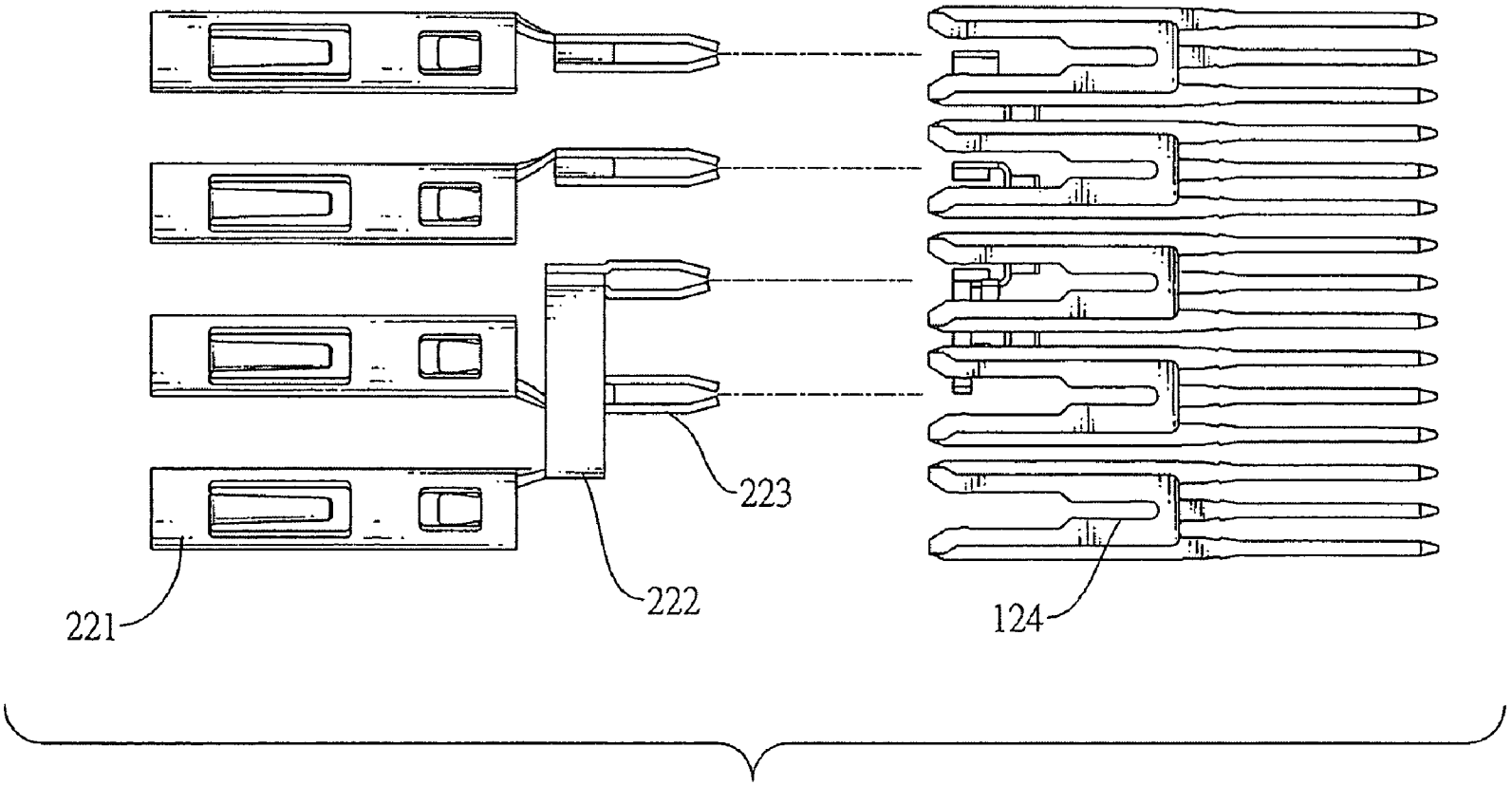
FIG. 13 is a top view of the internal elements in FIG. 12 without FDD power terminals.
Figure 14:
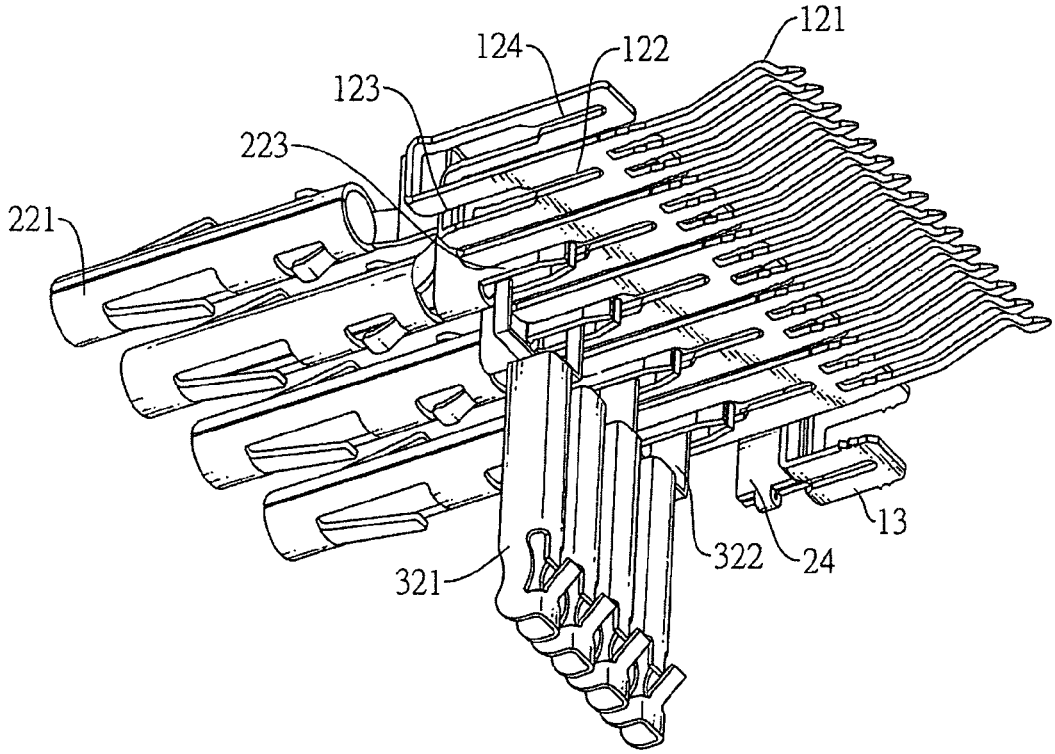
FIG. 14 is a perspective view of the internal elements in FIG. 12.
Figure 15:
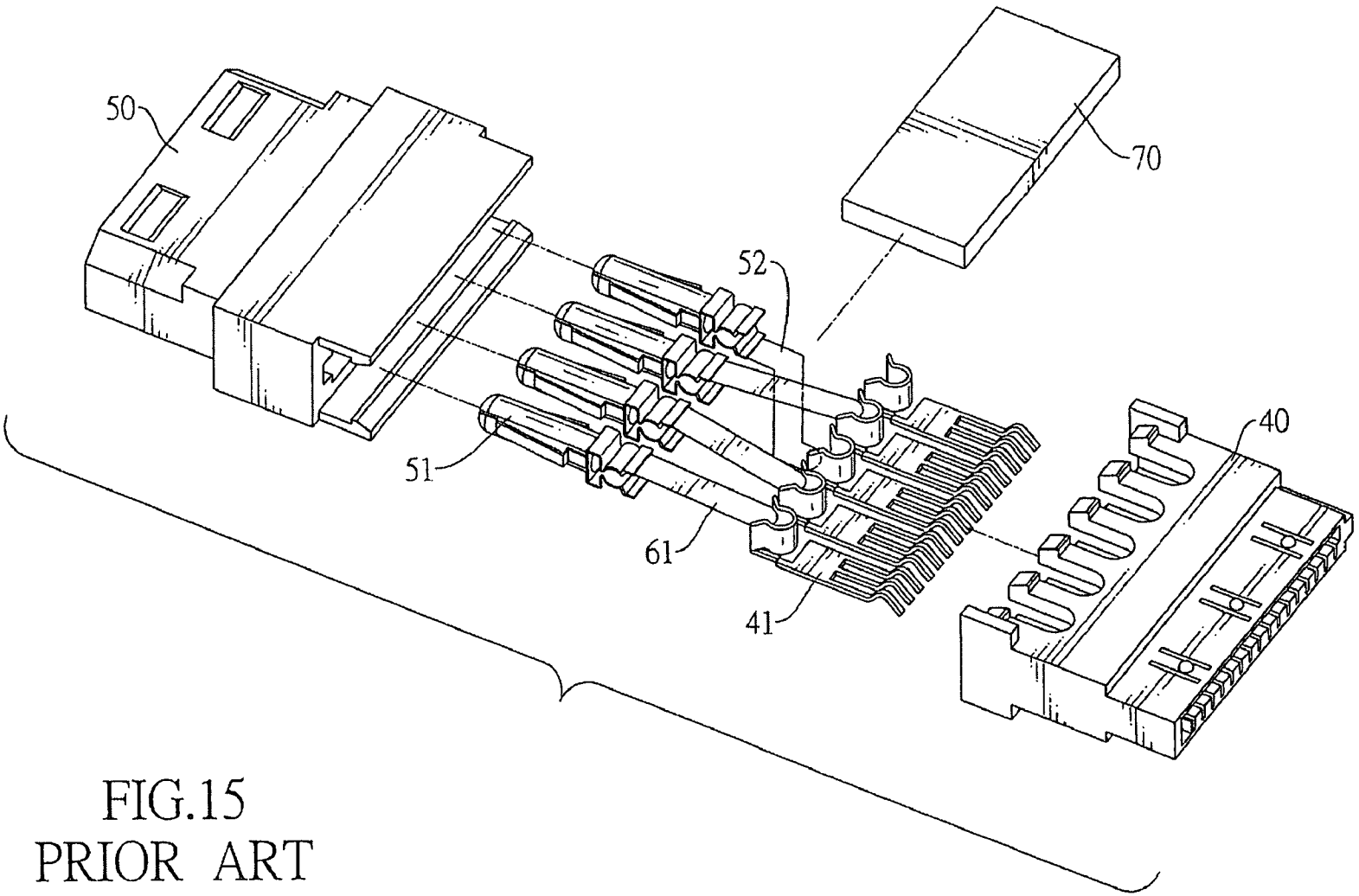
FIG.15 PRIOR ART
FIG. 15 is an exploded view of a conventional power connector

With further reference to FIG. 11, the FDD connector module (30) is detachably mounted in the FDD mount (214) of the IDE connector module (20) and comprises a FDD connector plug (31) and multiple FDD power terminals (32).

The FDD connector plug (31) is mounted in the FDD mount (214) on the IDE connector plug (21) and has a proximal end, a distal end, two edges and multiple terminal channels (311). The edges of the FDD connector plug (31) correspond respectively to the flat and guide edges on the SATA connector plug (11). The terminal channels (311) are formed through the proximal and distal ends of the FDD connector plug (31) and formed individually in series from the edge corresponding to the flat edge of the SATA connector plug (11) to the other edge of the FDD connector plug (31).

The FDD power terminals (32) comprise 5V, first ground, second ground and 12V FDD power terminals (32) contacting respectively with the 5V, first ground, second ground and 12V IDE power terminals (22). The 5V, first ground, second ground and 12V FDD power terminals (32) are mounted respectively in the terminal channels (311) from the edge corresponding to the flat edge of the SATA connector plug (11) to the other edge of the FDD connector plug (31). Each FDD power terminal (32) has a distal contact (321) and a proximal contact (322). The distal contacts (321) are mounted in the terminal channels (311) and are adapted to electrically connect to a FDD device. Each proximal contact (322) is formed on the distal contact (321) of a corresponding FDD power terminal (32). The 5V and first ground FDD power terminals (32) separably cross each other.

Therefore, the proximal ends of the FDD power terminals (32) are respectively contacted with the mounting contacts (223) of the IDE power terminals (22). In use, multiple power wires are mounted respectively through the through holes (113) and the static hole (114) and electrically contact with the center contacts (122) and the top contacts (124) on the SATA power terminals (12) and the static elimination clip (13). Preferably, a static ground wire is electrically connected to the static elimination clip (13) and a 3.3V wire, a first ground wire, a 5V wire, a second ground wire, and a 12V wire are respectively electrically connected to the 3.3V, first ground, 5V, second ground and 12V SATA power terminals (12).

Therefore, an insulation element is not required to be mounted in the IDE connector module (20) before assembling the IDE connector module (20) and the SATA connector module (10) because the connecting element (222) is mounted in and along the detour guide in the IDE connector plug (21) to prevent short circuiting. Further, since the detour guide on the inner surface of the chamber (212) of the IDE connector plug (21) is not mounted through the IDE and SATA power terminals (22, 12), the IDE and SATA power terminals (12, 22) are not broken easily during manufacture or jammed during use due to misalignment. In addition, the IDE connector module (10) and the SATA connector module (20) are independent and are detachably connected together because the IDE and SATA power terminals (12, 22) are mounted respectively in the IDE and SATA connector plug (11, 21). End-users can easily disassemble and reassemble the power cable connector.

Also, a FDD connector module (30) may be easily appended to further improve backwards compatibility of the connector of the present invention.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power cable connector compatible to Serial Advanced Technology Attachment (SATA) and Integrated Device Electronics (IDE) standards comprising:

a SATA connector module comprising a SATA connector plug having a top;

a bottom;

a connecting side;

a mounting side;

a flat edge;

a guide edge;

a slot being formed through the connecting side;

a guide protrusion being formed on and protruding from the guide edge;

multiple recesses being formed on the mounting side and communicating with the slot; and multiple through holes being formed through the top and the bottom of the SATA connector plug and corresponding respectively to and communicating with the recesses; and multiple SATA power terminals being mounted in the SATA connector plug, comprising 3.3V, first ground, 5V, second ground and 12 V SATA power terminals disposed in series from the flat edge to the guide edge and corresponding respectively to the recesses; and an IDE connector module being detachably connected to the SATA connector module and comprising an IDE connector plug having a mounting side;

a connecting side;

a bottom;

two edges corresponding respectively to the flat and guide edges on the SATA connector plug;

multiple terminal holes being formed through the connecting side of the IDE connector plug and formed individually in series from the edge of the IDE connector plug corresponding to the flat edge of the SATA connector plug to the other edge of the IDE connector plug;

a chamber being formed through the mounting side of the IDE connector plug, being detachably mounted around the mounting side of the SATA connector plug, communicating with the terminal holes and having an inner surface; and a detour guide being formed on the inner surface of the chamber and around one of the terminal holes; and multiple IDE power terminals comprising 5V, first ground, second ground and 12V IDE power terminals contacting respectively with the 5V, first ground, second ground and 12V SATA power terminals and being mounted respectively in the terminal holes of the IDE connector plug from the edge of the IDE connector plug corresponding to the flat edge of the SATA connector plug to the other edge of the IDE connector plug, and each IDE power terminal comprising a connecting contact being mounted in a corresponding terminal hole;

a connecting element being formed on the connecting contact of a corresponding IDE power terminal, and the connecting element of the 5V IDE power terminal being mounted along the detour guide in the IDE connector plug to detour round the connecting element of the first ground IDE power terminal; and a mounting contact being formed on the connecting element of the corresponding IDE power terminal and detachably contacting with a corresponding SATA power terminal.

2. The power cable connector as claimed in claim 1, wherein the detour guide is a guide notch formed in the inner surface of the chamber in the IDE connector plug.

3. The power cable connector as claimed in claim 1, wherein each SATA power terminal further has multiple connecting contacts being mounted in the slot;

a center contact being formed on the connecting contacts of a corresponding SATA power terminal and aligning with a corresponding through hole; and a mounting clip being formed on the center contact of the corresponding SATA power terminal and exposing through a corresponding recess; and a top contact being formed on the mounting clip and aligning with the center contact on the corresponding SATA power terminal and the corresponding through hole on the SATA connector plug.

4. The power cable connector as claimed in claim 3, wherein the detour guide is a guide notch formed in the inner surface of the chamber in the IDE connector plug.

5. The power cable connector as claimed in claim 1, wherein the detour guide is a relief ditch formed on the inner surface of the chamber in the IDE connector plug.

6. The power cable connector as claimed in claim 5, wherein each SATA power terminal further has multiple connecting contacts being mounted in the slot;

a center contact being formed on the connecting contacts of a corresponding SATA power terminal and aligning with a corresponding through hole; and a mounting clip being formed on the center contact of the corresponding SATA power terminal and exposing through a corresponding recess; and a top contact being formed on the mounting clip and aligning with the center contact on the corresponding SATA power terminal and the corresponding through hole on the SATA connector plug.

7. The power cable connector as claimed in claim 5, wherein:

the SATA connector plug further has a static hole being formed through the top and the bottom of the SATA connector plug adjacent to the guide edge of the SATA connector plug;

the SATA connector module further comprises a static elimination clip being mounted in the static hole and protruding from the mounting side of the SATA connector plug; and the IDE connector module further comprises a static cavity being formed in the inner surface of the chamber, being next to the 12V IDE power terminal and adjacent to the edge of the IDE connector plug corresponding to the guide edge of the SATA connector plug; and a static elimination piece being mounted in and protruding from the static cavity and detachably contacting the static elimination clip.

8. The power cable connector as claimed in claim 7, wherein each SATA power terminal further has multiple connecting contacts being mounted in the slot;

a center contact being formed on the connecting contacts of a corresponding SATA power terminal and aligning with a corresponding through hole; and a mounting clip being formed on the center contact of the corresponding SATA power terminal and exposing through a corresponding recess; and a top contact being formed on the mounting clip and aligning with the center contact on the corresponding SATA power terminal and the corresponding through hole on the SATA connector plug.

9. The power cable connector as claimed in claim 1, wherein:

the IDE connector plug further comprises a floppy disk drive (FDD) mount being formed on and through the bottom of the IDE connector plug; and the power cable connector further comprises a FDD connector module being mounted in the FDD mount and comprising a FDD connector plug being mounted in the FDD mount on the IDE connector plug and having a proximal end;

a distal end;

two edges corresponding respectively to the flat and guide edges on the SATA connector plug; and multiple terminal channels being formed through the proximal and the distal ends of the FDD connector plug and formed individually in series from the edge corresponding to the flat edge of the SATA connector plug to the other edge of the FDD connector plug; and multiple FDD power terminals comprising 5V, first ground, second ground and 12V FDD power terminals contacting respectively with the 5V, first ground, second ground and 12V IDE power terminals, being mounted respectively in the terminal channels from the edge corresponding to the flat edge of the SATA connector plug to the other edge of the FDD connector plug, and each FDD power terminal having a distal contact being mounted in a corresponding terminal channel; and a proximal contact being formed on the distal contact of a corresponding FDD power terminal, and the proximal contacts of the 5V and first ground FDD power terminals separably crossing each other.

10. The power cable connector as claimed in claim 9, wherein the detour guide is a guide notch formed in the inner surface of the chamber in the IDE connector plug.

11. The power cable connector as claimed in claim 9, wherein each SATA power terminal further has multiple connecting contacts being mounted in the slot;

a center contact being formed on the connecting contacts of a corresponding SATA power terminal and aligning with a corresponding through hole; and a mounting clip being formed on the center contact of the corresponding SATA power terminal and exposing through a corresponding recess; and a top contact being formed on the mounting clip and aligning with the center contact on the corresponding SATA power terminal and the corresponding through hole on the SATA connector plug.

12. The power cable connector as claimed in claim 11, wherein the detour guide is a guide notch formed in the inner surface of the chamber in the IDE connector plug.

13. The power cable connector as claimed in claim 9, wherein:

the SATA connector plug further has a static hole being formed through the top and the bottom of the SATA connector plug adjacent to the guide edge of the SATA connector plug;

the SATA connector module further comprises a static elimination clip being mounted in the static hole and protruding from the mounting side of the SATA connector plug; and the IDE connector module further comprises a static cavity being formed in the inner surface of the chamber, being next to the 12V IDE power terminal and adjacent to the edge of the IDE connector plug corresponding to the guide edge of the SATA connector plug; and a static elimination piece being mounted in and protruding from the static cavity and detachably contacting the static elimination clip.

14. The power cable connector as claimed in claim 13, wherein the detour guide is a guide notch formed in the inner surface of the chamber in the IDE connector plug.

15. The power cable connector as claimed in claim 13, wherein each SATA power terminal further has multiple connecting contacts being mounted in the slot;

a center contact being formed on the connecting contacts of a corresponding SATA power terminal and aligning with a corresponding through hole; and a mounting clip being formed on the center contact of the corresponding SATA power terminal and exposing through a corresponding recess; and a top contact being formed on the mounting clip and aligning with the center contact on the corresponding SATA power terminal and the corresponding through hole on the SATA connector plug.

16. The power cable connector as claimed in claim 15, wherein the detour guide is a guide notch formed in the inner surface of the chamber in the IDE connector plug.

17. The power cable connector as claimed in claim 1, wherein:

the SATA connector plug further has a static hole being formed through the top and the bottom of the SATA connector plug adjacent to the guide edge of the SATA connector plug;

the SATA connector module further comprises a static elimination clip being mounted in the static hole and protruding from the mounting side of the SATA connector plug; and the IDE connector module further comprises a static cavity being formed in the inner surface of the chamber, being next to the 12V IDE power terminal and adjacent to the edge of the IDE connector plug corresponding to the guide edge of the SATA connector plug; and a static elimination piece being mounted in and protruding from the static cavity and detachably contacting the static elimination clip.

18. The power cable connector as claimed in claim 17, wherein the detour guide is a guide notch formed in the inner surface of the chamber in the IDE connector plug.

19. The power cable connector as claimed in claim 17, wherein each SATA power terminal further has multiple connecting contacts being mounted in the slot;

a center contact being formed on the connecting contacts of a corresponding SATA power terminal and aligning with a corresponding through hole; and a mounting clip being formed on the center contact of the corresponding SATA power terminal and exposing through a corresponding recess; and a top contact being formed on the mounting clip and aligning with the center contact on the corresponding SATA power terminal and the corresponding through hole on the SATA connector plug.

20. The power cable connector as claimed in claim 19, wherein the detour guide is a guide notch formed in the inner surface of the chamber in the IDE connector plug.

* * * * *